United States Patent [19]

Schwartz et al.

[11] 4,256,002

[45] Mar. 17, 1981

[54] LARGE SCALE INTEGRATED CIRCUIT GENERATOR CHIP FOR ELECTRONIC ORGAN

[75] Inventors: Harold O. Schwartz, Elburn; William R. Hoskinson, Geneva, both of Ill.

[73] Assignee: The Wurlitzer Company, DeKalb, Ill.

[21] Appl. No.: 917,314

[22] Filed: Jun. 20, 1978

[51] Int. Cl.[3] ..... G10H 1/00

[52] U.S. Cl. ..... 84/1.01; 84/1.24

[58] Field of Search ..... 84/1.01, 1.03, 1.24, 84/DIG. 4

[56] References Cited

U.S. PATENT DOCUMENTS

| | | | |
|---|---|---|---|
| 3,610,799 | 10/1971 | Watson | 84/1.01 |
| 3,816,635 | 6/1974 | Uetrecht | 84/1.01 |
| 3,828,109 | 8/1974 | Morez | 84/1.01 |
| 3,990,339 | 11/1976 | Robinson et al. | 84/1.17 |
| 4,116,102 | 9/1978 | Tsunoo et al. | 84/1.01 |

OTHER PUBLICATIONS

J. Simonton, "Portable Mini Organ," Radio-Electronics, Jan. 1977, pp. 31-34.

J. Simes, "An Almost Locked Oscillator," Journal of the Audio Engineering Society, Jun. 1977, vol. 25, No. 6, pp. 394-395.

*Primary Examiner*—J. V. Truhe

*Assistant Examiner*—Forester W. Isen

*Attorney, Agent, or Firm*—Trexler, Wolters, Bushnell & Fosse, Ltd.

[57] ABSTRACT

In an electronic organ or the like constructed of a plurality of large scale integrated circuit (LSI) chips, the present disclosure relates to a generator chip. The chip is operative over one octave of notes, and a string of chips is cascaded to provide as many octaves as there are in the instrument.

6 Claims, 4 Drawing Figures

LARGE SCALE INTEGRATED CIRCUIT GENERATOR CHIP FOR ELECTRONIC ORGAN

BACKGROUND OF THE INVENTION

Electronic organs have been known for many years. Early electronic organs used various electro-mechanical devices for generating electrical oscillations corresponding to musical tones. Various types of electronic oscillators have been used to provide such oscillations. Some organs have used an independent oscillator for each tone. This is an expensive construction, and for cost saving reasons, it has been common practice to provide twelve oscillators to produce the semi tones of the top octave, and to use divide-by-two circuits to provide the tones in lower octaves. More recently, it has become well known to use a single radio frequency oscillator with divider circuits of different divider ratios to produce the top octave of tones. This system is sometimes known as a top octave synthesizer (TOS). Strings of divide-by-two circuits have been used to provide the notes in lower octaves of such an organ.

With the advent of reliable, large scale integrated circuit (LSI) chips, efforts have been made to construct electronic organs utilizing digital circuits. It is relatively easy to construct LSI chips that handle digital circuits whereas it is relatively difficult to fabricate analog circuits with such LSI chips.

OBJECTS AND BRIEF DISCLOSURE OF THE PRESENT INVENTION

It is an object of the present invention to provide a large scale integrated circuit chip with a plurality of frequency generators thereon with means for assigning the chip to a single octave of an electronic organ or the like.

It is an object of the present invention to provide a plurality of the aforesaid chips with means for cascading said chips whereby the chips are respectively operable over successive octaves.

It is a further object to provide a large scale integrated circuit chip having a plurality of frequency generators thereon for generating frequencies corresponding to musical tones, said chip having means for receiving multiplexed information and for assigning said chip to a particular octave before the note thereof is selected.

In carrying out the foregoing and other objects of the present invention, a large scale integrated circuit chip utilizing digital techniques is provided. The chip has provision for receiving multiplexed information including means for assigning the chip to a particular octave. The plurality of frequency generators on a chip then produce notes, if any, played without that octave.

THE DRAWINGS

The invention best will be understood with reference to the ensuing specification and accompanying drawings wherein:

FIG. 1 comprises an electrical wiring diagram illustrating octave assignment of the chip;

DETAILED DISCLOSURE

The present invention comprises but one of a plurality of large scale integrated chips used in constructing a modular expandable organ system. Such an organ system is shown in the co-pending patent application of Harold O. Schwartz, Dennis E. Kidd and William R. Hoskinson filed on June 20, 1978 under Ser. No. 917,310. Five frequency generators are provided on the present chip and all are playable in one assigned octave. Five notes within one octave is sufficient for playing most of all music heretofore written. The present chip is adaptable for the playing of a simple, one-octave organ, with only one chip being used, up through different pluralities of chips for a 37- or 44-note spinet organ to a 61-note organ manual.

Figure 1:
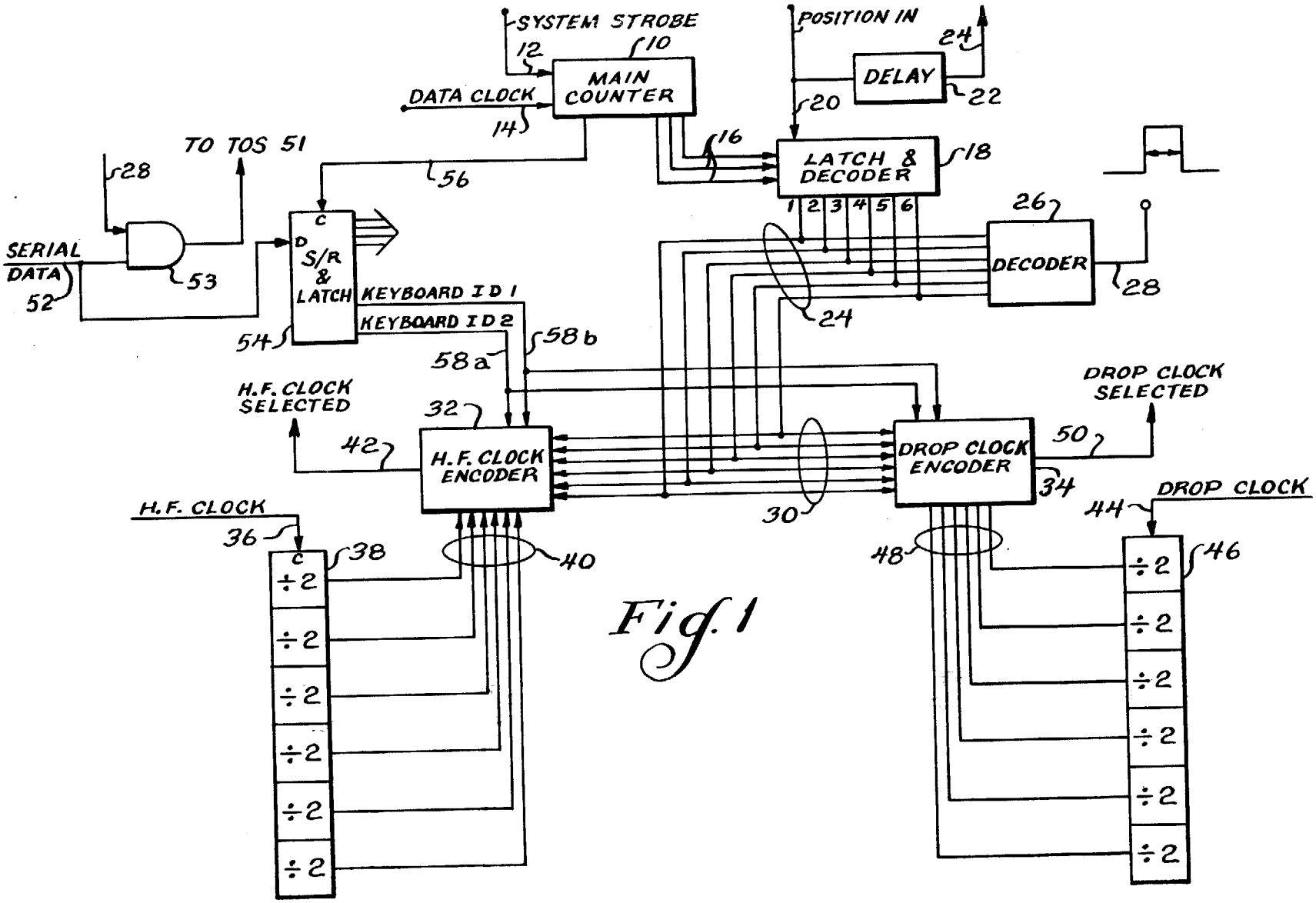

Turning first to FIG. 1, there is shown a main counter having a system strobe input 12 and a data clock input 14, both from outside of the chip. The main counter has three conductors 16 each carrying a bit of binary information leading to a latch and decoder 18. The three bits of binary information carried by the lines 16 is sufficient to provide up to a count of eight, but only six is used as will be set forth shortly hereinafter.

The latch and decoder 18 has another input 20 from an external source denoting position in. The input 20 is connected to a delay circuit 22 leading to a position out conductor which is available externally of the chip. The delay circuit 22 delays one count of the data clock. When a plurality of chips is cascaded, the first or lowest chip receives a system strobe pulse on its system strobe input and also on its position in input 20, thereby to assign that chip to the lowest octave. At the same time the system strobe input of each of the remaining cascaded chips receives a strobe pulse to clear all such chips. The data clock line 14 insures that all of the main counters 10, having been strobed, count in unison. The position out from the first chip is connected to the position in of the second chip, thereby to strobe the second chip's latch and decoder to assign that chip to the second octave. This progresses in sequence through as many as six chips, whereby all six chips are immediately assigned per octave in only six counts.

The latch and decoder 18 has six output lines 24. One of these lines will have a DC potential on its depending upon which octave the chip is assigned to. Thus, if the present chip is assigned to the lowest octave, there will be a logic "1" on the first of the lines 24. Substantially simultaneously the next succeeding cascaded chip will have a "1" on the second line 24, seriatim.

These lines are connected to a decoder 26 having an output 28 which produces an output pulse which is wide enough to cover the serial multiplexed data relating to the octave in which the present chip is assigned for gating such data into the TOS and assignment logic to be described hereinafter. The lines 24 are also connected to branch conductors 30 leading on one side to a high frequency clock encoder 32, and on the other side to a drop clock encoder 34. The drop clock encoding is similar to that disclosed and claimed in the co-pending patent application of Anthony C. Ippolito and William R. Hoskinson filed June 20, 1978 under Ser. No. 917,296. The purpose thereof is to de-tune each oscillator slightly from its intended or nominal frequency, whereby to avoid locking together of generator frequencies and to produce a more natural-sounding musical tone aggregation. An added characteristic utilized in this chip is the scaling of both the high frequency clock and the drop clock frequency to fit the octave to which the chip is assigned. This causes a constant percentage shift of generator frequency.

The present chip has a high frequency clock input 36 from outside the chip connected to a string of divide-by-two circuits 38. Six divide-by-two circuits are provided to cover six octaves of a manual, and there are six output connections 40 leading from the divide-by-two string 38 to the high frequency clock encoder 32. One of the divided clock frequencies appearing on the high frequency clock encoder is assigned according to which of the octave assignment lines 24 is high, thereby to provide an output at 42 which is related and corresponds to the octave to which the particular chip has been assigned.

The chip also is provided with an input connector 44 of a drop clock frequency connected to a string of divide-by-two circuits 46. Like the string of high frequency clock dividers 38, there are six drop clock dividers to cover the entire gamut of an organ keyboard. The six output conductors 48 from the divide-by-two string 46 are connected to the drop clock encoder 34. The drop clock encoder has an output conductor 50 which, like the high frequency clock output conductor 42, is related to the octave to which the chip is assigned.

It is desired that the frequency deviation as produced through the use of the drop clock should be in the same percentage throughout the entire gamut of the organ keyboard. Thus, if the high frequency clock is at 4 Mhz in at 36, while the drop clock in at 44 is at 4 KHz, then the output of the first divide-by-two circuit in the high frequency string 38 is two MHz, while the output of the first divider string 46 is 2 KHz. This continues on down the two strings so that the percentage deviation is the same no matter where the chip is assigned on the keyboard.

The chip is provided with another input connection 52 from exterior of the chip, and carrying multiplexed serial data information from the keyboard. The serial data leads to a two input AND gate 53. The other input to AND gate 53 is the conductor 28 leading from the decoder 26. The gated serial data output 51 of AND gate 53 lead to the TOS's 60, 62, 64, 66, and 68 of FIG. 2 The serial data input connection 52 also leads to a shift register and latch 54 which is clocked by way of a conductor 56 from the main counter 10. The shift register and latch has several parallel output conductors 58. Two of these parallel outputs 58A and 58D are latched keyboard identification information for use in the high frequency clock encoder 32, and the drop clock encoder 34.

Figure 2:
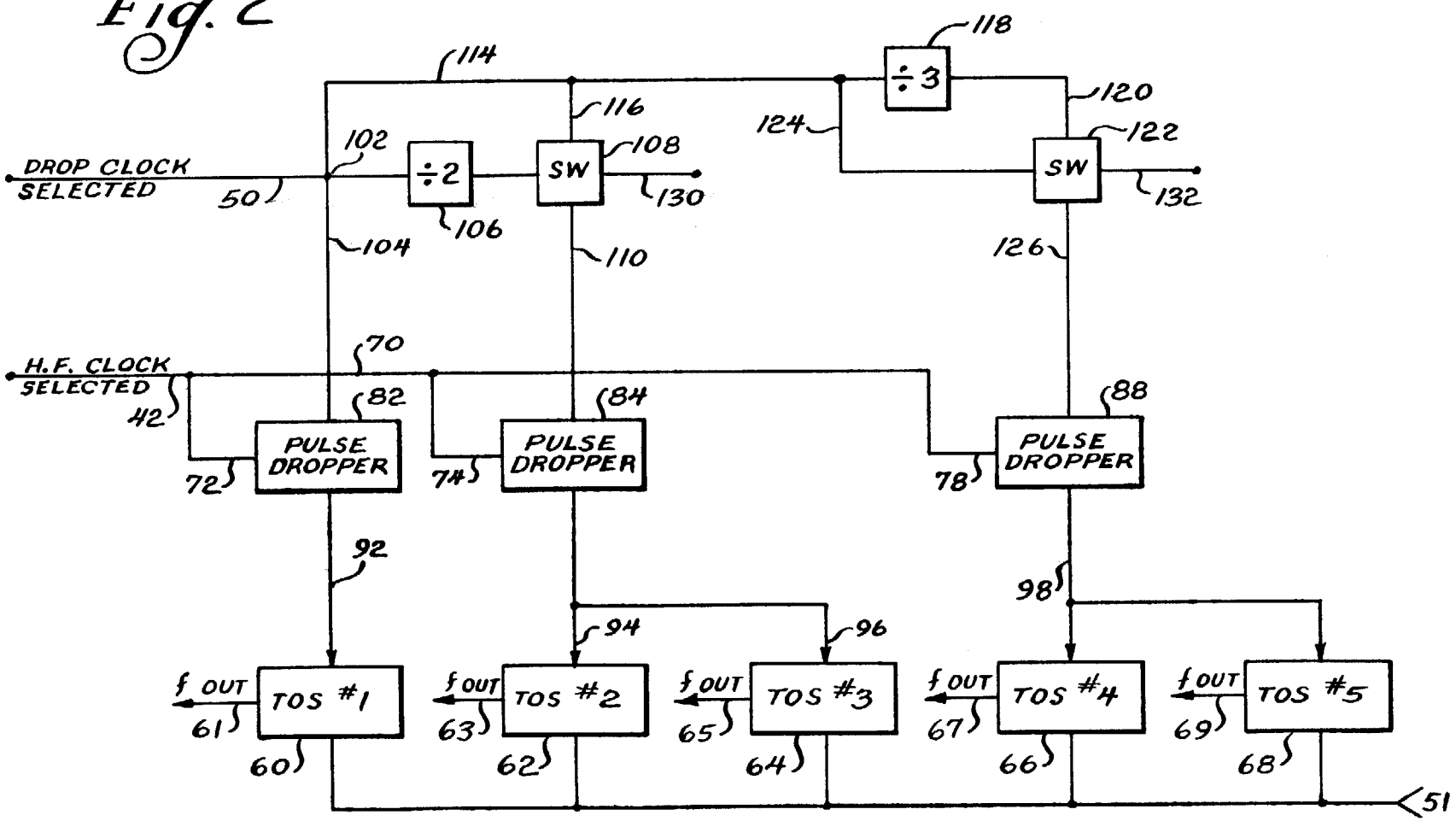
FIG.2 is an electrical wiring diagram illustrating note generation within the selected octave.

Turning to FIG. 2, there will be seen the five top octave synthesizers 60, 62, 64, 66, and 68. The conductor 51 leads to each TOS with octavely related keyswitch information. How the notes are assigned within the octave window is generally the same as the generator assignment disclosed in the copending application of Harold O. Schwartz and Dennis E. Kidd, filed June 20, 1978 under Ser. No. 917,313.

The high frequency clock selected at 42 is connected to a bus 70 which has branches 72, 74, and 78 to respective pulse droppers 82, 84, and 88 respectively having outputs 92, 94, and 98. Output 92 is connected to an input of TOS 60, output 94 is connected to an input of TOS 62 and TOS 64, and output 98 is connected to an input of TOS 66 and TOS 68. Each TOS 60, 62, 64, 66, and 68 respectively have outputs 61, 63, 65, 67, and 69 which are related to musical tones as are requested by the organ user.

The drop clock selected connection at 50 leads to a junction 102, having a conductor 104 therefrom to the first pulse dropper 82. The junction also is connected to a divide-by-two circuit 106 leading to a switch 108. The switch has an output leading at 110 to the second pulse dropper 84.

The junction 102 further is connected to a line 114 from which a branch connector 116 leads as an input to the switch 108. The conductor 114 also leads to the input of a divide-by-three circuit 118 having the output thereof connected at 120 to a switch 122. A branch connection 124 from the conductor 114 leads to the switch 122. The switch has an output conductor 126 leading to the third pulse dropper 88.

Each of the switches 108 and 122 is a two-position switch and the switch 108 has an input conductor 130 and the switch 122 an input conductor 132 for remote application of information to cause each switch to conduct from the adjacent divider, or to conduct from the drop clock selected frequency in at 50 without division. Preferably, the input information at 130 and at 132 is decoded from multiplexed data derived from stop or other control switches on the organ keyboard.

The drop clock or pulse dropper circuitry is the same as disclosed in the aforesaid copending application of Ippolito and Hoskinson. The high frequency clock selected input at 42, comprises a digital rectangular wave of approximately 50% duty cycle. A pulse is dropped every so often in accordance with the drop clock selected frequency at 50 and 104, thus causing the top octave synthesizer 60 to be slightly de-tuned from its normal frequency. The top octave synthesizers 62 and 64 are both de-tuned from their normal frequencies by the same amount, but differently from the de-tuning of the top octave synthesizer 60 if the switch 108 is in such position as to effect conduction from the divide-by-two circuit 106. Similarly, the top octave synthesizers 66 and 68 will both be de-tuned by the same amount, but different from the first three top octave synthesizers, assuming that the switch 122 is in proper position to conduct from the divide-by-three circuit 118. If the switches 108 and 122 are set by the respective input conductors 130 and 132 to bypass the dividers, the top octave synthesizers are all similarly de-tuned, and a vibrato effect can be produced in this manner.

Figure 3:
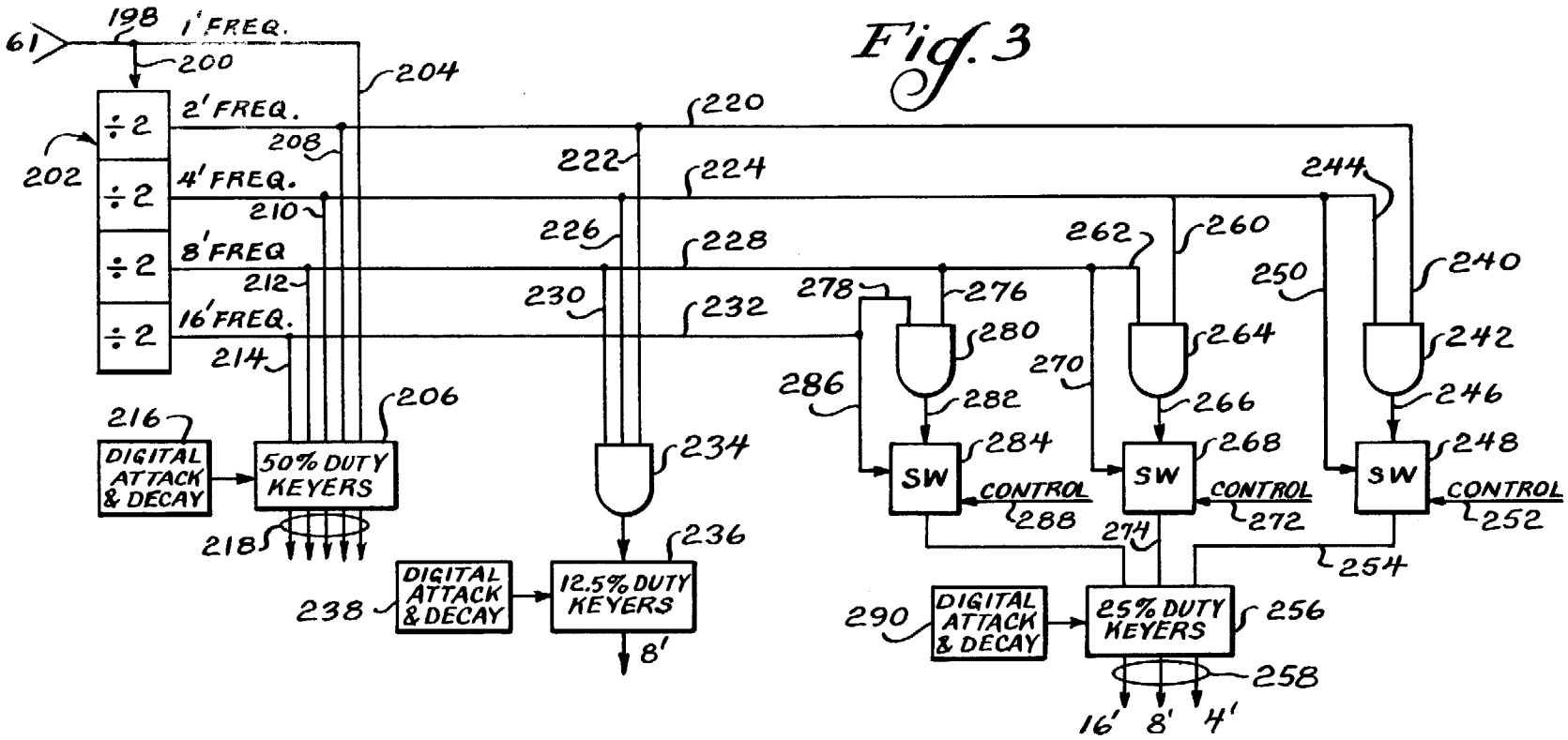
FIG. 3 is an electrical wiring diagram illustrating circuitry utilized to alter the duty cycle of generated frequency waveforms.

Turning now to FIG. 3, the output frequency 61 from the first TOS is applied to a conductor 198 branching at 200 to the first of a series of four divide-by-two circuits 202. The conductor 198 continues as an input line 204 to a 50% duty cycle keyers circuit 206. The frequency on conductors 198, 204 is a square wave (50% duty cycle rectangular wave) at a one foot pitch or footage. The outputs of successive divide-by-two circuits are connected respectively to input lines 208, 210, 212, and 212 to the 50% duty cycle keyer 206, respectively at two foot, four foot, eight foot, and sixteen foot pitches. Attack and decay is controlled by a digital attack and decay circuit 216, the operation of which is fully set forth in the copending application of William R. Hoskinson filed June 20, 1978 under Ser. No. 917,308. For present purposes it is sufficient to state that variable duty cycle rectangular waves having user controlled duty cycles act to control the attack and decay of the 50% duty cycle rectangular waves keyed by the keyers 206 to outputs 218.

The two foot output appears on a line 220 having a branch 222. Similarly, the four foot output appears on line 224 having a branch 226, the eight foot output appears on a line 228 having a branch 230, and the sixteen foot output appears on a line 232. The branches 222, 226, and 230 are inputs to a three input AND gate 234 which combines the 50% duty cycle rectangular waves in octave relation to form a 12.5% duty cycle output applied to a 12.5% duty cycle keyer 236 under control of digital attack and decay circuits 238.

The line 220 leads to one input 240 of a two input AND gate 242. The other input 244 of the gate is from line 224. The output 246 of AND gate 242 is connected to a switch 248. A bypass 250 leads from line 220 to switch 248. An external control line 252 operates the switch to one of two positions, either to pass the gate output comprising a four foot pitch at 25% duty cycle, or the four foot 50% duty cycle rectangular wave. The output 254 of switch 252 leads to 25% duty cycle keyers 256 having sixteen foot, eight foot, and four foot outputs 254.

Similarly, conductors 224 and 228 lead to inputs 260 and 262 of AND gate 264. Output 266 of this gate leads to a switch 268. A bypass 270 leads from conductor 262 to switch 268. A control 272 from an external source operates switch 268. The output 274 of switch 268 leads to the 25% duty cycle keyers 256.

In like manner conductors 228 and 232 lead to inputs 276 and 278 of an AND gate 280 having an output 282 to a switch 284. A bypass 286 leads from conductor 232 to switch 284, and a control line 288 controls the switch for an external control. A digital attack and decay circuit 290 is provided connected to the 25% duty cycle keyers 256.

It previously has been noted that switch 248 gives a choice of four foot 50% duty cycle rectangular wave or a four foot 25% duty cycle rectangular wave. Similarly, switch 268 gives a choice of an eight foot 50% duty cycle rectangular wave or an eight foot 25% duty cycle rectangular wave, while switch 284 affords either a sixteen foot 50% duty cycle rectangular wave of a sixteen foot 25% duty cycle wave.

Figure 4:
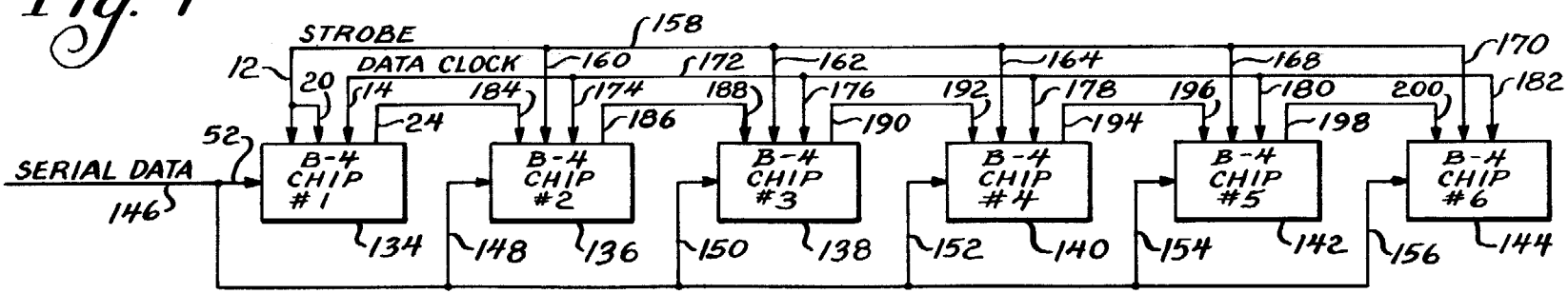
FIG. 4 is an electrical wiring diagram illustrating the cascading of a plurality of chips to produce frequencies over a plurality of octaves.

The manner in which a plurality of the present chips is interconnected to cover the gamut of an organ keyboard is shown in FIG. 4. Six the the B-4 chips forming the subject matter of the present invention are illustrated at 134, 136, 138, 140, 142, and 144. A serial data line 146 carrying multiplexed serial data from the keyboard of the organ is connected at 52 at a first chip, this chip having been the one illustrated in part in FIG. 1. The serial data line 146 is also connected at 148, 150, 152, 154, and 156 to the remaining B-4 chips 136, 138, 140, 142, and 144, respectively.

A system probe line 158 is provided which is common to all chips in the organ to provide proper timed operation thereof. The strobe line 158 is connected to the first B-4 chip at 12, as previously noted. It is also connected in case of the first chip to the position in conductor 20. It is also connected to the remaining chips at 160, 162, 164, 168, and 170, respectively.

A data clock line 172 also is provided from a position exterior of the present chips, and is connected to the first chip at 14 as previously noted. It is also connected to the remaining B-4 chips at 174, 176, 178, 180, and 182, respectively.

The position out connector 24 of the first B-4 chip is connected to the position in connector 184 of the second B-4 chip 136. The position out connector 186 of this chip is connected to the position in connector 188 of the next chip. The position out connector 190 of the chip 138 is connected to the position in connection 192 of the chip 140. The position out connector 194 of this chip is connected at the position in connector 196 of the chip 142, while the output connection 198 of this chip is connected at the input connection 200 of the sixth chip 144.

Since each chip represents one octave, it will be apparent that five chips are sufficient for 60 notes. A full organ commonly has a 61-note keyboard, so the sixth chip handles one note. Four chips are sufficient to cover 48 notes, whereby four chips are sufficient for common spinet organs which have 44 or sometimes 37 notes. Since each chip plays only in one octave, the output frequencies thereof are on a per octave basis, whereby the output frequencies can be filtered on an octave basis, rather than on a keyboard-wide basis.

The circuits shown may be embodied either using separate integrated circuits connected in the manner shown or a single integrated circuit incorporating all of the elements shown. Such an integrated circuit may be fabricated using process techniques well known in the semiconductor industry, desirably in metal oxide silicon (MOS) form. Since such techniques do not form a part of this invention, they will not be described in further detail.

The referenced copending applications and the present application are all assigned to The Wurlitzer Company, DeKalb, Illinois.

The specific example of the present invention is for illustrative purposes. Various changes will not doubt occur to those skilled in the art, and will be understood as comprising a part of the present invention insofar as they fall within the spirit and scope of the appended claims.

The invention is claimed as follows:

1. A plurality of like large scale integrated circuit chips for use in an electronic organ or the like having a keyboard and multiplexed key switches, each of said chips having a counter, means for synchronizing the counters of said plurality of chips, each chip having a high frequency clock input receiving a high frequency clock signal from outside of said chip, a string of divide-by-two circuits driven by said high frequency clock receiving input and having a plurality of octavely-related outputs, a high frequency clock encoder receiving said octavely-related divide-by-two outputs, each chip having a position in connection and a position out connection, delay means connecting the position in and the position out connections of each chip, means combining the counter output information and the position in information means connecting said combining means to said high frequency clock encoder to limit the output thereof to a particular octave, and an assignable frequency synthesizer connected to said high frequency clock encoder output to determine the octave in which said frequency synthesizer will operate, and means external of said chips interconnecting the position out connection of one chip with the position in connection of a succeeding chip.

2. A circuit chip as set forth in claim 1 wherein said plurality of chips are coupled in a series, and the position in connection of the first chip of the series is interconnected with the counter synchronizing means.

3. The combination as set forth in claim 1 wherein each chip has a plurality of frequency generators all operating within the same octave.

4. A large scale integrated circuit chip for use in an electronic organ or the like having a keyboard and multiplexed key switches, said chip comprising a plurality of assignable frequency generators each capable of generating any of a plurality of frequencies corresponding to musical tones associated with said key switches, means interconnected with said frequency generators and said key switches to restrict said frequency generators to a predetermined one octave of said musical tones associated with said key switches, further means interconnected with said frequency generators and said key switches and responsive to operation of each key switch for assigning one of said frequency generators to the generation of a tone signal corresponding to the operated key switch, said further means including means for receiving a high frequency from an external high frequency clock, divide-by-two circuit means connected to said receiving means to provide octavely related clock frequencies, high frequency clock encoding means receiving the output of said divide-by-two circuit means, means receiving information external to said chip and connected to said high frequency clock encoding means for selecting an encoding of the high frequency clock corresponding to said predetermined one octave of musical tones associated with said key switches, and means interconnected with said high frequency clock encoding means and said frequency generators to enable the generation thereby of different frequencies within said predetermined one octave, said circuit chip further including means for receiving the selected high frequency clock encoding, said selected high frequency clock encoding means being interconnected with said frequency generators, drop clock receiving means for receiving an external drop clock signal of a lower frequency than said high frequency clock, and means interconnecting said selected high frequency clock encoding means and said drop clock receiving means for periodically dropping pulses from the high frequency clock signal to reduce the frequency thereof, there being different numbers of pulses dropped for different generators in said predetermined one octave.

5. A circuit chip as set forth in claim 4 and further including means for receiving a drop clock frequency generated externally of said chip, divide-by-two circuit means interconnected with said drop clock receiving means for providing drop clock frequencies which are related by a factor of two to said incoming drop clock frequency, drop clock encoding means interconnected with the outputs of said drop clock divide-by-two circuit means, the means receiving an exterior signal also being interconnected with said drop clock encoding means to provide a selected drop clock frequency, and means interrelating said selected drop clock frequency with said selected frequency of said high frequency clock periodically to drop pulses from said high frequency clock frequency whereby a frequency generator controlled by said high frequency diode frequency is detuned from its denominated frequency.

6. A large scale integrated circuit chip for use in an electronic organ or the like having a keyboard and multiplexed key switches, said chip comprising a plurality of frequency generators each capable of generating any of a plurality of frequencies corresponding to musical tones, means for receiving a high frequency clock signal from outside said chip, a string of divide-by-two circuits connected to the high frequency clock means and having a plurality of outputs at harmonically related frequencies, a high frequency clock encoder receiving the outputs of the divide-by-two string, a counter driven by an external data clock signal, a latch and decoder interconnected with said counter, output means from said latch and decoder connected to said high frequency clock encoder, means for receiving an external timing pulse and connected to said latch and decoder to cause said high frequency clock encoder to produce an output frequency corresponding to a particular octave, a shift register and latch receiving multiplexed data from said key switches, said shift register and latch being clocked from said counter, said shift register and latch having output means connected to said high frequency clock encoder for supplying key switch information thereto, drop clock receiving means for receiving a drop clock frequency from outside said chip, a second divide-by-two circuit string driven by said drop clock frequency receiving means and providing a plurality of outputs having respective octave relationships, drop clock encoding means receiving said outputs, and means interconnecting said latch and decoder with said drop clock encoding means to provide a drop clock selected output frequency bearing a predetermined relationship with the high frequency clock selected frequency from said high frequency clock encoder.

* * * * *